US010088287B2

(12) United States Patent
Carlson et al.

(10) Patent No.: US 10,088,287 B2
(45) **Date of Patent: *Oct. 2, 2018**

(54) SPIN-STABILIZED NON-LETHAL PROJECTILE WITH A SHEAR-THINNING FLUID

(71) Applicant: Vista Outdoor Operations LLC, Farmington, UT (US)

(72) Inventors: Erik K. Carlson, Oak Grove, MN (US); Joshua L. Edel, East Bethel, MN (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/832,320

(22) Filed: Dec. 5, 2017

(65) Prior Publication Data

US 2018/0164084 A1 Jun. 14, 2018

Related U.S. Application Data

(63) Continuation of application No. 15/179,219, filed on Jun. 10, 2016, now Pat. No. 9,835,426, which is a (Continued)

(51) Int. Cl.
*F42B 8/16* (2006.01)
*F42B 12/40* (2006.01)
(Continued)

(52) U.S. Cl.
CPC ..... *F42B 12/40* (2013.01); *F42B 8/16* (2013.01); *F42B 10/26* (2013.01); *F42B 12/36* (2013.01); *F42B 12/74* (2013.01); *F42B 12/76* (2013.01)

(58) Field of Classification Search
CPC ..... F42B 8/00; F42B 8/12; F42B 8/14; F42B 8/16; F42B 12/36; F42B 12/40; F42B 6/00; F42B 6/10
(Continued)

(56) References Cited

U.S. PATENT DOCUMENTS 459,417 A 9/1891 Sherlock et al.
1,417,475 A 5/1922 Weeke
(Continued)

FOREIGN PATENT DOCUMENTS

CA 2 294 867 A1 1/1999
CA 2 594 864 A1 12/2005
(Continued)

*Primary Examiner* — Jonathan C Weber
(74) *Attorney, Agent, or Firm* — Christensen, Fonder, Dardi & Herbert PLLC

(57) ABSTRACT

A non-lethal projectile having a shear-thinning fluid within an interior cavity. The shear-thinning fluid having a greater apparent viscosity at low shear rates to spin-stabilize the non-lethal projectile during flight and a lower apparent viscosity at a high shear rate corresponding with the shear-thinning fluid shearing against the frangible cap upon the non-lethal projectile striking the target, with the low viscosity of the shear-thinning fluid allowing proper dispersal upon impact with the target. The shear-thinning fluid can comprise a marking media and be in the form of an emulsion with less than about 50% liquid by volume to effectively disperse upon impact with the target.

19 Claims, 6 Drawing Sheets

Related U.S. Application Data continuation of application No. 14/372,723, filed as application No. PCT/US2013/021751 on Jan. 16, 2013, now Pat. No. 9,470,492.

(60) Provisional application No. 61/587,100, filed on Jan. 16, 2012.

(51) Int. Cl.

| | |
|---|---|
| ***F42B 10/26*** | (2006.01) |
| ***F42B 12/36*** | (2006.01) |
| ***F42B 12/74*** | (2006.01) |
| ***F42B 12/76*** | (2006.01) |

(58) Field of Classification Search

USPC ..... 102/367, 370, 498, 502, 513, 529, 430, 102/439, 444, 501

See application file for complete search history.

(56) References Cited

U.S. PATENT DOCUMENTS

| | | | |
|---|---|---|---|
| 2,629,600 | A | 2/1953 | Edmonds |
| 3,584,582 | A | 6/1971 | Muller |
| 3,865,038 | A | 2/1975 | Barr |
| 3,911,824 | A | 10/1975 | Barr et al. |
| 3,983,817 | A | 10/1976 | Tucker |
| 4,128,059 | A | 12/1978 | Black |
| 4,326,463 | A | 4/1982 | Burke et al. |
| H114 | H | 8/1986 | Quintavalle |
| 4,884,508 | A | 12/1989 | Kruse et al. |
| 4,958,570 | A | 9/1990 | Harris |
| 5,035,183 | A | 7/1991 | Luxton |
| 5,354,225 | A | 10/1994 | Hix |
| 5,388,524 | A | 2/1995 | Strandli et al. |
| 5,591,796 | A | 1/1997 | Wisniewski et al. |
| 5,654,524 | A | 8/1997 | Saxby |
| 5,740,626 | A | 4/1998 | Schuetz et al. |
| 5,749,949 | A | 5/1998 | Tavares |
| 5,937,563 | A | 8/1999 | Schuetz et al. |
| 6,393,992 | B1 | 5/2002 | Vasel et al. |
| 6,409,811 | B1 | 6/2002 | Tavares et al. |
| 6,450,100 | B1 | 9/2002 | Carson |
| 6,530,962 | B1 | 3/2003 | Stolz |
| 6,543,365 | B1 | 4/2003 | Vasel et al. |
| 6,619,211 | B1 | 9/2003 | Haeselich |
| 6,669,763 | B1 | 12/2003 | Ghodoussi |
| 6,807,908 | B2 | 10/2004 | Brydges-Price |
| 7,086,337 | B2 | 8/2006 | Klein |
| 7,121,211 | B2 | 10/2006 | Beal |
| 7,143,699 | B2 | 12/2006 | Brock et al. |
| 7,207,276 | B1 | 4/2007 | Dindl |
| 7,225,741 | B2 | 6/2007 | Huffman |
| 7,278,358 | B2 | 10/2007 | Huffman |
| 7,287,475 | B2 | 10/2007 | Brunn |
| 7,331,293 | B2 | 2/2008 | Saxby |
| 7,475,638 | B2 | 1/2009 | Haeselich |
| 7,487,728 | B2 | 2/2009 | Cranor |
| 7,621,208 | B2 | 11/2009 | Huffman |
| 7,819,065 | B2 | 10/2010 | Haeselich |
| 7,883,774 | B1 | 2/2011 | Baggs |
| 7,913,626 | B1 | 3/2011 | Reinhardt et al. |
| 7,984,668 | B2 | 7/2011 | Huffman |
| 8,065,962 | B2 | 11/2011 | Haeselich |
| 8,146,505 | B2 | 4/2012 | Huffman |
| 8,297,187 | B2 | 10/2012 | Sullivan |
| 8,327,767 | B2 | 12/2012 | Lafortune |
| 8,485,102 | B2 | 7/2013 | Carlson et al. |
| 9,273,941 | B2 | 3/2016 | Carlson et al. |
| 9,470,492 | B2 * | 10/2016 | Carlson ..... F42B 8/16 |
| 9,494,397 | B2 | 11/2016 | Carlson et al. |
| 9,835,426 | B2 * | 12/2017 | Carlson ..... F42B 12/40 |
| 2002/0112640 | A1 | 8/2002 | Brown et al. |
| 2004/0052746 | A1 | 3/2004 | Tamareselvy et al. |
| 2004/0089186 | A1 | 5/2004 | Brygdes-Price |
| 2004/0241130 | A1 | 12/2004 | Tamareselvy et al. |
| 2005/0066841 | A1 | 3/2005 | Vasel et al. |
| 2005/0066849 | A1 | 3/2005 | Kapeles et al. |
| 2005/0183612 | A1 | 8/2005 | Huffman |
| 2005/0229807 | A1 | 10/2005 | Brock et al. |
| 2006/0011090 | A1 | 1/2006 | Vasel et al. |
| 2006/0027128 | A1 | 2/2006 | Hober |
| 2006/0032393 | A1 | 2/2006 | Haeselich |
| 2006/0040834 | A1 | 2/2006 | Hilliard, Jr. et al. |
| 2006/0048668 | A1 | 3/2006 | Williams |
| 2006/0239953 | A1 | 10/2006 | Clapp et al. |
| 2007/0071781 | A1 | 3/2007 | Louys, Jr. et al. |
| 2007/0079722 | A1 | 4/2007 | Parish |
| 2007/0089627 | A1 | 4/2007 | Brock et al. |
| 2007/0119329 | A1 | 5/2007 | Haeselich |
| 2007/0151473 | A1 | 7/2007 | Brunn |
| 2007/0245920 | A1 | 10/2007 | Henriksson et al. |
| 2007/0282067 | A1 | 12/2007 | Backman et al. |
| 2007/0289475 | A1 | 12/2007 | Kapeles |
| 2008/0000464 | A1 | 1/2008 | Campo et al. |
| 2008/0053330 | A1 | 3/2008 | Haeselich |
| 2008/0178728 | A1 | 7/2008 | Kapeles et al. |
| 2008/0178758 | A1 | 7/2008 | Kapeles et al. |
| 2008/0213322 | A1 | 9/2008 | Birman et al. |
| 2009/0101038 | A1 | 4/2009 | Kapeles et al. |
| 2009/0126602 | A1 | 5/2009 | Murphy et al. |
| 2009/0253862 | A1 | 10/2009 | Hasinovic |
| 2010/0083862 | A1 | 4/2010 | Ciesium et al. |
| 2010/0263568 | A1 | 10/2010 | Huffman |
| 2010/0269724 | A1 | 10/2010 | Head et al. |
| 2011/0023744 | A1 | 2/2011 | Endicott, Jr. et al. |
| 2011/0067593 | A1 | 3/2011 | Klein |
| 2011/0079164 | A1 | 4/2011 | Broden et al. |
| 2011/0252999 | A1 | 10/2011 | Carlson et al. |

FOREIGN PATENT DOCUMENTS

| | | | |
|---|---|---|---|
| EP | 1 962 048 | A2 | 8/2008 |
| FR | 2323981 | A1 | 4/1977 |
| WO | WO 93/16349 | A1 | 8/1993 |
| WO | WO 2005/076787 | A2 | 8/2005 |
| WO | WO 2005/119165 | A2 | 12/2005 |

* cited by examiner

SPIN-STABILIZED NON-LETHAL PROJECTILE WITH A SHEAR-THINNING FLUID

CROSS-REFERENCE TO RELATED APPLICATIONS

The present application is a continuation of U.S. patent application Ser. No. 15/179,219, filed Jun. 10, 2016, which is a continuation of U.S. patent application Ser. No. 14/372,723, filed Jul. 16, 2014, now U.S. Pat. No. 9,470,492, which is a National Stage Entry of PCT/US2013/021751 filed Jan. 16, 2013, which claims the benefit of U.S. Provisional Application No. 61/587,100, filed Jan. 16, 2012, all of which are hereby incorporated by reference herein in their entireties.

FIELD OF THE INVENTION

The present invention is generally directed to non-lethal projectiles having a shear-thinning or pseudoplastic fluid that has a greater apparent viscosity at low shear rates to spin stabilize the non-lethal projectile during flight and a lower apparent viscosity at high shear impact with the target to properly disperse the fluid onto the target. The non-lethal projectiles with shear-thinning marking fluid have improved ballistic and a shelf-stability characteristics.

BACKGROUND OF THE INVENTION

Recently, the use of non-lethal projectiles for training and recreational purposes in place of conventional bullets has increased. The non-lethal projectiles are often constructed of low-weight, frangible materials that fracture upon impact with the target lessening the momentum transferred by the impact, thereby reducing the likelihood of injury or terminal damage. The projectiles often comprise a polymer material instead of the heavier metal or metal composites used in conventional bullets to reduce the overall weight of the projectile and correspondingly the momentum transferred from the projectile to the target upon impact. The lower weight also allows the projectile to be fired with a reduced propellant charge and travel at a lower speed to further reduce the likelihood of damage to the target. In many applications, a marking fluid or other payload is placed in a space within the projectile such that the marking fluid is dispensed from the projectile upon impact to mark the impact site.

The drawback of using a lightweight projectile is that the lower weight used to reduce the impact energy of the projectile also inherently worsens the ballistic characteristics of the projectile. Specifically, the lower weight reduces the effective range in which the projectile can be fired with reasonable accuracy due to a lower ballistic coefficient than a comparable conventional bullet. A common approach to improving the effective range of the lightweight projectile is to increase the muzzle velocity of the projectile. This increased muzzle velocity compensates for the reduced weight to increase the momentum of the projectile such that the effective range of the projectile increases.

However, the increased muzzle velocity creates a standoff distance within which the projectile is travelling sufficiently fast to possibly cause excessive or lethal damage. As a result, compensating for the reduced weight of the projectile by increasing the muzzle velocity of the projectile also increases the standoff distance.

The marking fluid can generally improve the ballistic characteristics of the projectile by filling the hollow interior of the projectile with a liquid medium that increases the overall weight of the projectile. The dissipation of the liquid medium upon impact also provides the dual benefit of reducing the force of the impact. However, if the marking fluid solidifies as a result of excessively high or low temperatures or other storage conditions, the solid projectile can prevent or hinder the fracturing of the projectile thereby reducing the amount of impact energy dissipated by the deformation of the projectile. The solid marking media also impacts with more force than marking fluids as the solid media will not dissipate as readily as marking fluid. Similarly, the storage conditions can cause the marking fluid to separate into solid and liquid phases; or otherwise cause the marking fluid to dry out. The uneven weight of the different phases or a dried out marking fluid can cause unpredictable or poor ballistic characteristics. As non-lethal marking ammunition is often used by the military in places where ideal storage conditions may not be available, the likelihood of the storage conditions having a negative effect on the marking fluid and ultimately the ballistic performance of the projectile is high.

Similarly, spin stabilization is difficult with a liquid filled projectile, as the liquid may not spin at a rate matching or proximate to the spin of the projectile, such that the slower spinning liquid mass moving inside a spinning projectile may cause the projectile rotation to decrease prematurely resulting in an unstable projectile. In addition, any unevenness in the liquid mass can cause the weight of the projectile to shift during flight introducing wobble or otherwise impacting the stability of the projectile. Unstable projectiles rapidly lose velocity leading to decreased range and accuracy.

Moreover, the media needs to be non-toxic and easily removable from clothing such as camouflaged clothing used during training. Ideally, the clothing marked with the marking projectiles could be completely cleaned without the use of heated water or detergents as these may not be readily available.

Lightweight projectiles loaded with marking fluid have significant advantages when used for non-lethal or training purposes. However, the storage limitations of the marking media can reduce the overall effectiveness of the projectile or even increase the likelihood of the injury from using the projectile. There is also a need for a marking media that does not negatively impact the ballistic characteristics of the projectile by changing the weight distribution of the projectile in flight. As such, there is a need for a self-stable marking fluid that can improve the ballistic characteristics of the projectile and maintain proper dispersion upon impact without increasing the likelihood of injury or otherwise causing terminal damage to the target.

SUMMARY OF THE INVENTION

The present invention is directed at a non-lethal projectile having a shell with a cavity therein, the cavity containing a shear-thinning fluid, wherein the shear-thinning fluid has a greater viscosity at low shear rates to spin-stabilize the projectile during flight and a lower viscosity at higher shear rates corresponding with the shear-shinning fluid shearing against pieces of the projectile shell upon impact with a target, the lower viscosity at high shear rates providing proper dispersal of the shear-thinning fluid upon impact with the target. In some aspects, the shear-thinning fluid contains a marking media, such as a colorant, a colorant with a color additive, or the like, that provides a visual marking upon impact with the target. In some aspects, the shear-thinning fluid has a viscosity of less than about 30 Pa·sat a shear rate of about 15 Hz or more, in some aspects at about 20 Hz or more, in some aspects at about 25 Hz or more, in some aspects at about 30 Hz or more, in some aspects at about 35 Hz or more, in some aspects at about 40 Hz or more, in some aspects at about 45 Hz or more, and in some aspects at about 50 Hz or more, at about 25° C. In some aspects, the shear-thinning fluid has a viscosity greater than about 560 Pa·sat a shear rate of about 2 Hz at about 25° C., and in some aspects a viscosity greater than about 560 Pa·sat a shear rate less than about 3 Hz at about 25° C.

In some aspects, the shear-thinning fluid at a shear rate of about 2 Hz or less at about 25° C. has a viscosity greater than about 130 Pa·s, in some aspects greater than about 140 Pa·s, in some aspects greater than about 160 Pa·s, in some aspects greater than about 180 Pa·s, in some aspects greater than about 200 Pa·s, in some aspects greater than about 220 Pa·s, in some aspects greater than about 240 Pa·s, in some aspects greater than about 260 Pa·s, in some aspects greater than about 280 Pa·s, in some aspects greater than about 300 Pa·s, in some aspects greater than about 320 Pa·s, in some aspects greater than about 340 Pa·s, in some aspects greater than about 360 Pa·s, in some aspects greater than about 380 Pa·s, in some aspects greater than about 400 Pa·s, in some aspects greater than about 420 Pa·s, in some aspects greater than about 440 Pa·s, in some aspects greater than about 460 Pa·s, in some aspects greater than about 480 Pa·s, in some aspects greater than about 500 Pa·s, in some aspects greater than about 520 Pa·s, in some aspects greater than about 540 Pa·sand in some aspects greater than about 560 Pa·s.

In some aspects, the shear-thinning fluid at a shear rate of about 3 Hz or less at about 25° C. has a viscosity greater than about 130 Pa·s, in some aspects greater than about 140 Pa·s, in some aspects greater than about 160 Pa·s, in some aspects greater than about 180 Pa·s, in some aspects greater than about 200 Pa·s, in some aspects greater than about 220 Pa·s, in some aspects greater than about 240 Pa·s, in some aspects greater than about 260 Pa·s, in some aspects greater than about 280 Pa·s, in some aspects greater than about 300 Pa·s, in some aspects greater than about 320 Pa·s, in some aspects greater than about 340 Pa·s, in some aspects greater than about 360 Pa·s, in some aspects greater than about 380 Pa·s, in some aspects greater than about 400 Pa·s, in some aspects greater than about 420 Pa·s, in some aspects greater than about 440 Pa·s, in some aspects greater than about 460 Pa·s, in some aspects greater than about 480 Pa·s, in some aspects greater than about 500 Pa·s, in some aspects greater than about 520 Pa·s, in some aspects greater than about 540 Pa·sand in some aspects greater than about 560 Pa·s.

In some aspects, the non-lethal projectile of the present invention does not contain any material such as metallic balls or pieces to drive the shear-thinning fluid from the projectile shell. In some aspects, the non-lethal projectile is essentially devoid of any metal or metal composite materials, with the exception of an optional driving band that allows a spin to be imparted upon the projectile when fired from a rifled barrel.

In some aspects, the non-lethal projectile of the present invention comprises glycerin in an amount from about 50 wt % to about 70 wt %, water in an amount from about 12 wt % to about 20 wt %, an emulsifying agent, such as glyceryl stearate, PEG-100 stearate, petrolatum, glycol strearate, and mixtures thereof, in an amount from about 30 wt % to about 45 wt %, an acrylate crosspolymer, such as a Cio-30 alkyl acrylate crosspolymer, in an amount from about 0.4 wt % to about 0.5 wt %, a colorant, a color additive such as zinc oxide and/or a buffer such as triethanoamine 99%. In some aspects of the present invention, the shear-thinning fluid is a shear-thinning emulsion. The shear-thinning fluid can comprise less than about 50% by volume of a liquid portion, in other aspects less than about 40% by volume of a liquid portion, and still in other aspects, less than about 25% by volume of a liquid portion. In some aspects, the shear-thinning fluid has a pH between about 7 and about 8.

In some aspects, the non-lethal projectile of the present invention having a shear-thinning fluid is used in a small arms cartridge, such as a 5.56 mm cartridge, a .223 cartridge, a 9 mm cartridge, in place of the conventional bullet. In some aspects, the non-lethal projectile has a rotational speed of at least 30,000 rpm when fired from a rifled barrel at a target.

In some aspects, the shear-thinning fluid is contained with a two-part projectile shell, the two-part shell having a cup connected to a frangible cap to provide an interior cavity, the shear-thinning fluid contained within the interior cavity. In some aspects, the shell comprises a polymeric material. Upon impact with a target, the cap breaks into small pieces or shards, such that the shear-thinning fluid is sheared across the pieces or shards and allowing the viscosity of the shear-thinning fluid to be reduced to properly disperse upon the target. In some aspects, the shear-thinning fluid properly disperses upon the target at a viscosity of about 30,000 cP or less. In some aspects, the shear-thinning fluid has a viscosity of about 30,000 cP or less at a shear rate of about 40 Hz or more at about 25° C., in some aspects at a shear rate of about 45 Hz or more at about 25° C., in some aspects at a shear rate of about 50 Hz or more at about 25° C., and in some other aspects at a shear rate of about 55 Hz or more at about 25° C.

In some aspects, the present invention is directed to a glycerin based marking media that is concentrated to improve the shelf-stability and performance characteristics of the marking media. The high density of the marking media improves the ballistic characteristics of the projectile by increasing the overall weight of the projectile. At the same time, the marking media has sufficiently fluidity to properly disperse upon impact with the target. In addition, concentrating the marking media allows the media to remain fluidic and resist separation into solid and liquid phases when stored for long periods of time at either high or low temperatures. The marking media can be colored for tracking the source of each impact and other purposes.

A method of making the marking media, according to certain aspects of the present invention, can comprise forming an emulsion by agitating a quantity of water with an acrylate cross-polymer to hydrate the cross-polymer. The method further comprises adding glycerin to the water and hydrated cross-polymer emulsion. The method also comprises heating the mixture to a first temperature while agitating the emulsion. Once the emulsion is heated to the first temperature, the method comprises mixing a buffer solution into the emulsion to buffer the pH of the solution to about pH 6.0. The method then comprises cooling the mixture to a second temperature. In one aspect, the method can comprise adding a colorant and zinc oxide into the mixture at an intermediary temperature between the first and second temperatures. After the cooling the mixture to the second temperature, the method comprises reheating the mixture to a third temperature and maintaining the emulsion at that temperature until the emulsion separates into a solid phase and a liquid phase, wherein the emulsion is about 40% solid phase by volume and 60%>liquid phase by volume.

The method then comprises decanting a portion of the emulsion in the liquid phase from the mixture until the mixture is less than 50% liquid by volume. Finally, the method comprises cooling and mixing the solid phase and remaining liquid phase until the emulsion is primarily in the liquid phase.

Alternatively, the initial amounts of water and glycerin by volume added to the emulsion can be reduce such that the resulting emulsion after cooling the emulsion to the second temperature is about or less than 50%>liquid by volume. In this configuration, the additional reheating and decanting steps are not required.

In one aspect, the glycerin based marking media is water soluble and can be removed by washing the clothing in cold water or rubbing with a wet towel or sponge. In addition, the marking media is primarily glycerin and water, neither of which is toxic for humans or the environment allowing use of the marking media without the fear of leaving toxic residue on the target or surrounding environment.

In one aspect of the present invention, the marking media can be placed within a non-lethal projectile comprising a cup portion for receiving the marking media and a frangible cap for retaining the marking media within the projectile until impact. The non-lethal projectile can comprise a lightweight polymer body for reducing the momentum of the projectile. In one aspect, the projectile can comprise at least one driving band positioned around the exterior of the projectile to engage the rifling the firearm as the projectile travels down the barrel to impart spin to the projectile.

In one aspect of the present invention, the non-lethal projectile can be propelled a reduced energy cartridge adapted to propel the projectile with gases generated only by a primer rather than a propellant charge in an equivalent lethal cartridge. The cartridge can comprise a cartridge casing and a telescoping insert adapted to telescope upon firing to trigger the cycling mechanism of the firearm. The cartridge casing can define an internal cavity having a first opening for receiving the cup portion of the projectile and a second opening for receiving the primer.

The above summary of the various representative embodiments and aspects of the present invention is not intended to describe each illustrated embodiment or every implementation of the present invention. Rather, the aspects and embodiments are chosen and described so that others skilled in the art can appreciate and understand the principles and practices of the present invention. The figures in the detailed description that follow more particularly exemplify these embodiments and aspects thereof.

BRIEF DESCRIPTION OF THE DRAWINGS

The invention can be completely understood in consideration of the following detailed description of various embodiments of the invention in connection with the accompanying drawings, in which.

Figure 1:
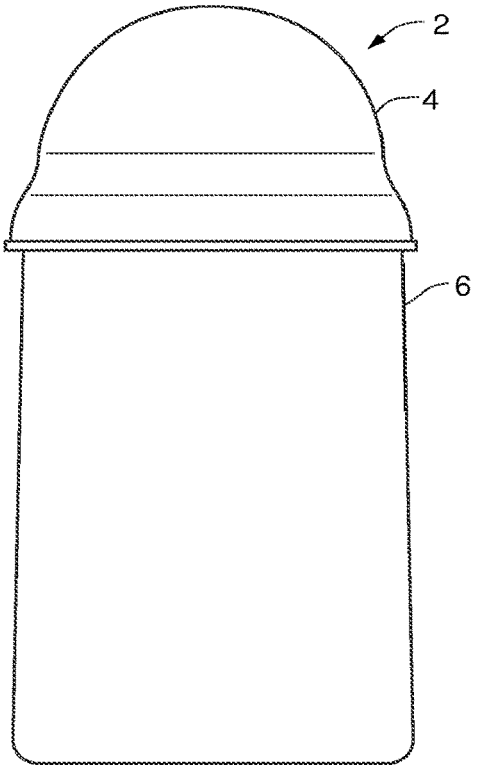
FIG. 1 is a side view of a non-lethal projectile band according to an embodiment of the present invention.
Figure 2:
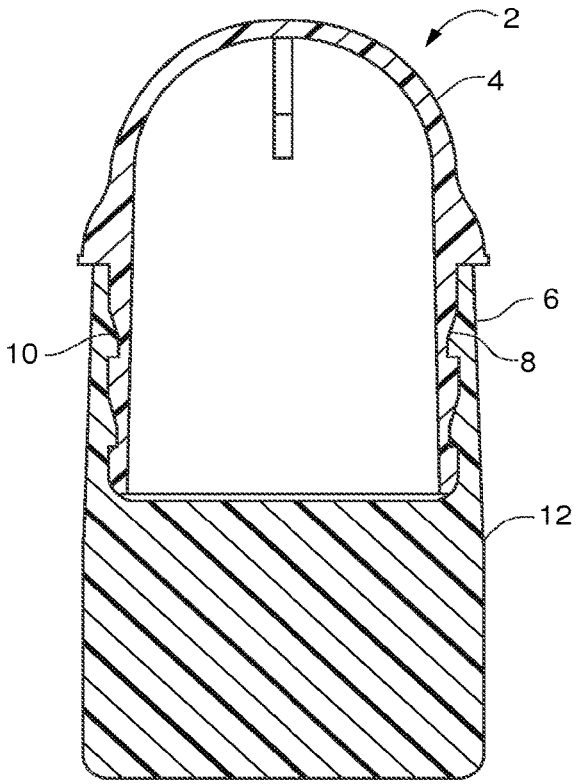
FIG. 2 is a cross-sectional side view of the non-lethal projectile depicted in FIG. 1.
Figure 3:
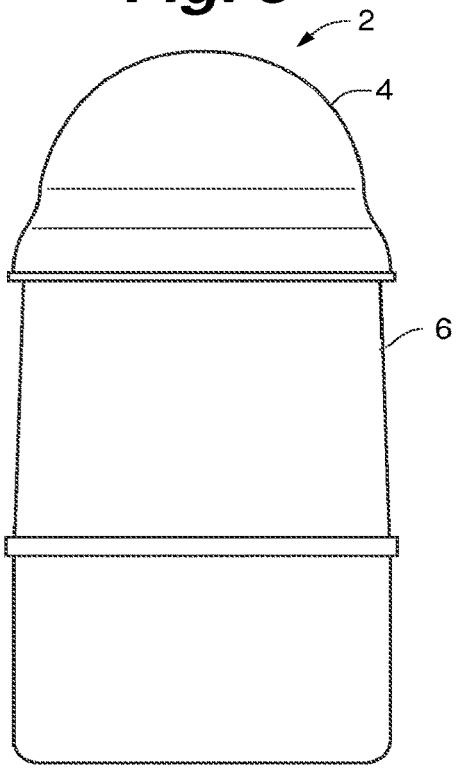
FIG. 3 is a side view of a non-lethal projectile with a driving band according to an embodiment of the present invention.
Figure 4:
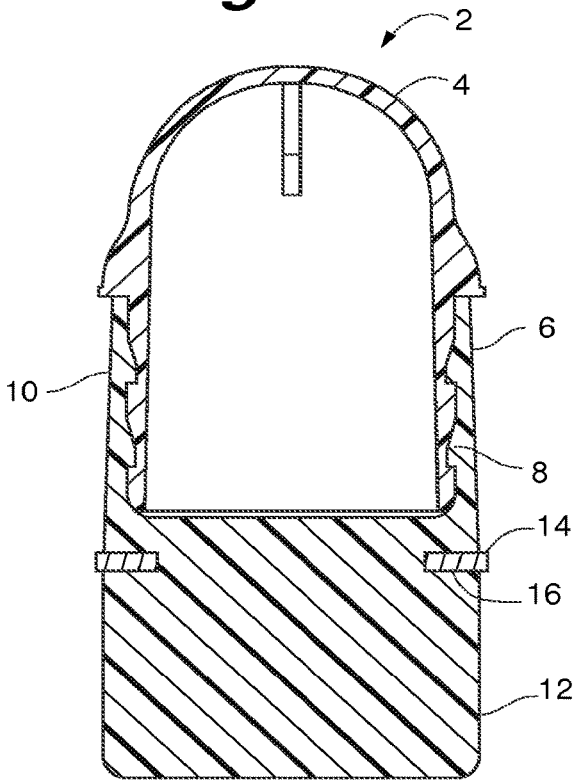
FIG. 4 is a cross-sectional side view of the non-lethal projectile depicted in FIG. 3.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

A non-lethal projectile 2, according to certain aspects of the present invention, can comprise a shell having two or more parts that connect together to form an interior cavity 50. A shear-thinning fluid can be inserted within the interior cavity 50, the shear-thinning fluid having a greater viscosity at low shear rates to spin-stabilize the projectile during flight and a lower viscosity at higher shear rates to properly disperse the shear-thinning fluid upon impact with the target. Upon impact with the target, the shear-thinning fluid shears against pieces or shards of the shell at high shear rates such that the viscosity of the shear-thinning fluid is much lower compared to the in flight viscosity of the shear-thinning fluid. During the initial rotation of the non-lethal projectile 2, there is shear between the walls of the shell and the shear-thinning fluid, as well as between the shear-thinning fluid and itself. It is desirable that the shear-thinning fluid have enough viscosity, at the shear rate imparted by the rotation, that the rotation does not cause the shear-thinning fluid to move around inside the projectile; but instead, to properly rotate with the shell such that the non-lethal projectile is spin-stabilized and does not tumble. When the projectile strikes a target, the velocity of the projectile drops to zero immediately, leading to a high shear event. The high shear drops the viscosity of the shear-thinning fluid enough to allow the fluid to leave the projectile shell and deposit or disperse onto the target.

In some aspects, the shear-thinning fluid contains a marking media, such as a colorant, a colorant with a color additive, or the like, that provides a visual marking of the projectile upon striking the target.

In some aspects, in order to spin-stabilize the projectile, the shear-thinning fluid has a viscosity greater than about 560 Pa·sat a shear rate less than about 2 Hz at about 25° C., and in some aspects a viscosity greater than about 560 Pa·sat a shear rate less than about 3 Hz at about 25° C.

In some aspects, in order to provide a proper dispersal of the shear-thinning fluid upon the target upon impact, the shear-thinning fluid has a viscosity of less than about 30 Pa·sat a shear rate of about 50 Hz at about 25° C. In some aspects, the viscosity of the shear-thinning fluid is less than about 30 Pa·sat shear rates greater than about 50 Hz at about 25° C.

In some aspects, the shear-thinning fluid has a viscosity of about 30 Pa·sor less at a shear rate of about 45 Hz or more at about 25° C., in some aspects at a shear rate of about 40 Hz or more at about 25° C., in some aspects at a shear rate of about 35 Hz or more at about 25° C., in some other aspects at a shear rate of about 30 Hz or more at about 25° C., in some other aspects at a shear rate of about 25 Hz or more at about 25° C., in some other aspects at a shear rate of about 20 Hz or more at about 25° C., and in some other aspects at a shear rate of about 15 Hz or more at about 25° C.

In some aspects, the shear-thinning fluid has a viscosity of about 20 Pa·sor less at a shear rates greater than about 80 Hz at about 25° C.

In some aspects, the shear-thinning fluid has a viscosity of less than about 25 Pa·sat a shear rate of 20 Hz or more, in some aspects at about 25 Hz or more, in some aspects at about 30 Hz or more, in some aspects at about 35 Hz or more, in some aspects at about 40 Hz or more, in some aspects at about 45 Hz or more, and in some aspects at about 50 Hz or more, at about 25° C.

In some aspects, the shear-thinning fluid at a shear rate of about 2 Hz or less at about 25° C. has a viscosity greater than about 130 Pa·s, in some aspects greater than about 140 Pa s, in some aspects greater than about 160 Pa·s, in some aspects greater than about 180 Pa s, in some aspects greater than about 200 Pa·s, in some aspects greater than about 220 Pa s, in some aspects greater than about 240 Pa·s, in some aspects greater than about 260 Pa s, in some aspects greater than about 280 Pa·s, in some aspects greater than about 300 Pa s, in some aspects greater than about 320 Pa·s, in some aspects greater than about 340 Pa s, in some aspects greater than about 360 Pa·s, in some aspects greater than about 380 Pa s, in some aspects greater than about 400 Pa·s, in some aspects greater than about 420 Pa s, in some aspects greater than about 440 Pa·s, in some aspects greater than about 460 Pa s, in some aspects greater than about 480 Pa·s, in some aspects greater than about 500 Pa s, in some aspects greater than about 520 Pa·s, in some aspects greater than about 540 Pa s, in some aspects greater than about 560 Pa·s, in some aspects greater than about 580 Pa s, in some aspects greater than about 600 Pa·s., in some aspects greater than about 700 Pa s, in some aspects greater than about 800 Pa·s., in some aspects greater than about 900 Pa·s, and in some aspects greater than about 1000 Pa·s.

In some aspects, the shear-thinning fluid at a shear rate of about 3 Hz or less at about 25° C. has a viscosity greater than about 130 Pa·s, in some aspects greater than about 140 Pa·s, in some aspects greater than about 160 Pa·s, in some aspects greater than about 180 Pa·s, in some aspects greater than about 200 Pa·s, in some aspects greater than about 220 Pa·s, in some aspects greater than about 240 Pa·s, in some aspects greater than about 260 Pa·s, in some aspects greater than about 280 Pa·s, in some aspects greater than about 300 Pa·s, in some aspects greater than about 320 Pa·s, in some aspects greater than about 340 Pa·s, in some aspects greater than about 360 Pa·s, in some aspects greater than about 380 Pa·s, in some aspects greater than about 400 Pa·s, in some aspects greater than about 420 Pa·s, in some aspects greater than about 440 Pa·s, in some aspects greater than about 460 Pa·s, in some aspects greater than about 480 Pa·s, in some aspects greater than about 500 Pa·s, in some aspects greater than about 520 Pa·s, in some aspects greater than about 540 Pa·sand in some aspects greater than about 560 Pa·s, in some aspects greater than about 580 Pa·s, in some aspects greater than about 600 Pa·s., in some aspects greater than about 700 Pa·s, in some aspects greater than about 800 Pa·s., in some aspects greater than about 900 Pa·s, and in some aspects greater than about 1000 Pa·s.

In some aspects, the shear-thinning fluid has a viscosity of about 300 Pa·sto about 1000 Pa·sat a shear rate less than about 1, in some aspects less than about 2 Hz, and in some aspects less than about 3 Hz, at 25° C., and wherein the shear-thinning marking fluid has a viscosity of less than about 30 Pa·sat a shear rate greater than about 15 Hz, in some aspects a shear rate of about 20 Hz or more, in some aspects at about 25 Hz or more, in some aspects at about 30 Hz or more, in some aspects at about 35 Hz or more, in some aspects at about 40 Hz or more, in some aspects at about 45 Hz or more, and in some other aspects at about 50 Hz or more, at about 25° C.

A marking media, according to certain aspects of the present invention, can comprise an emulsion of glycerin, water, acrylate cross-polymer and an emulsifying additive selected from the group of Glyceryl Stearate, PEG-100 Stearate, Petrolatum, Glycol Stearate and combinations thereof. Similarly, the cross-polymer can comprise, but is not limited to Carbomer ETD 2020. In one aspect, the marking media can include a colorant and a color additive such as, but not limited to, zinc oxide. In one aspect, the emulsion can comprise about or less than 50% liquid by volume. In another aspect, the marking media can further comprise a buffer including, but not limited to triethanolamine 99%.

In another aspect, the emulsion can comprise about or less than 40% liquid by volume. In yet another aspect, the emulsion can comprise about or less than 25% liquid by volume. The amount of liquid in the marking media can be adjusted to provide the desired balance between dispersion of the marking media upon impact and stable shelf-life of the marking media, wherein a greater percentage of liquid improves the dispersion of the marking media upon impact and a lower percentage of liquid improves the shelf-life of the marking media. In one aspect, the marking media can have a pH 7.0 to 8.0. Similarly, the marking media can have a specific gravity of at least 0.9-1.0.

A method of making the marking media, according to an embodiment of the present invention, can comprise agitating a quantity of water with the cross-polymer to hydrate the cross-polymer. In one aspect, the amount of water added corresponds to about 15 to 20 wt % of the total marking media made. Similarly, in one aspect, the amount of cross-polymer added corresponds to about 0.4 to 0.5 wt % of the total marking media made. The water and cross-polymer mixture is highly agitated until the cross-polymer is hydrated. In one aspect, the mixture is agitated for about 20 to 40 minutes. In another aspect, the mixture is agitated for about 30 minutes.

After hydration of the cross-polymer, the glycerin and additives are added to the mixture and the resulting emulsion is heated to a first temperature. In one aspect, the amount of glycerin added corresponds to about 50 to 70 wt % of the total marking media made. Similarly, in one aspect, the additives added corresponds to about 30 to 45 wt % of the total marking media made. In yet another aspect, when multiple additives are used each additive is added in equal amounts such that the total amount of additives used corresponds to about 30 to 45% of the total marking media made. The first temperature can range from 65 to 85° C. in one aspect of the invention. In yet another aspect, the first temperature can be about 75° C.

Once the emulsion reaches the first temperature, the buffer solution is added to the emulsion until the solution is about pH 6.0. The method is then cooled to a second temperature. In one aspect, the second temperature can be about room temperature (22° C.).

In one aspect, the colorant and color additive can be added to the emulsion as the emulsion cools from the first temperature and prior to the emulsion reaching second temperature. The intermediate temperature can range from 60 to 70° C. in one aspect and can be about 65° C. in another aspect.

In one aspect, after the emulsion is cooled to room temperature, the emulsion can be reheated to a third temperature until the emulsion separates into a liquid phase and a solid phase. The amount of the emulsion in the liquid phase can be about 60% by volume while the amount of the emulsion in the solid phase can be about 40% by volume in one aspect. The third temperature can be about 60 to 70° C. in one aspect and about 65° C. in another aspect. In one aspect, the emulsion can be maintained at the third temperature for about 12 to 36 hours to facilitate separation of the emulsion into liquid and solid phases.

After the separation, a portion of the liquid phase can be decanted from the emulsion until the about of liquid in the emulsion is at least about or less than 50% by volume. The amount of liquid in the emulsion can be continually to at least 40% in one aspect or 25% in another aspect. Once the liquid has been decanted the emulsion can be cooled and remixed into a single phase.

In one aspect, the initial amounts of water and glycerol can be lowered such that the resulting marking media is less than or about 50%. In this configuration, the reheating and decanting steps are no longer necessary.

As shown in FIGS. 1 to 4, a non-lethal projectile 2, according to an embodiment of the present invention, comprises a frangible cap 4 and a projectile body 6. The frangible cap 4 can further comprise an engagement portion 8 for affixing the cap 4 to the projectile body 6. The projectile body 6 can further comprise a cup portion 10 and a base portion 12. The engagement portion 8 is receivable within the cup portion 10 to affix the cap 4 to the projectile body 6 and to define a cavity for receiving marking media. In one aspect, the projectile can further comprise a driving band 14 extending around the exterior of the projectile body 6. The driving band 14 can be positioned around the base portion 12 of the projectile body 6. A portion of the driving band 14 protrudes from outward from the projectile body 6 to engage the rifling of a barrel the projectile 2 is fired through. The projectile body 6 can further comprise a groove 16 for receiving a portion of the driving band 8 to prevent the driving band 14 from moving axially during firing.

According to certain aspects, the projectile 2 can be sized to replicate the size of the bullet for 5.56×45 mm NATO ("5.56 NATO") or .223 REMINGTON ammunition. The conventional bullets of 5.56 NATO cartridges and .223 REMINGTON have a diameter of 0.224 in (5.70 mm). In one aspect, the driving band 14 can have an outer diameter of 0.223 in (5.66 mm) and a thickness of 0.005 (0.127 mm) in such that a portion of the driving band 14 protrudes from the projectile body 6 for engaging the rifling of barrels sized for 5.56 NATO or .223 REMINGTON ammunition. According to an embodiment, the inner diameter of the driving band 16 can comprise 0.154 in (3.912 mm) such that a portion of the driving band 16 is seated within the projectile body 6.

Although the projectile 2 is sized to approximate the conventional equivalent, the weight of the projectile 2 is less than the conventional equivalent. A conventional bullet weight for a 5.56 NATO bullet can be about 4 grams. In one embodiment, the total weight of the projectile 2 for simulating 5.56 NATO bullet and containing a payload media can weight about 0.24 grams wherein the driving band 8 comprises about 15% of the total weight of the projectile 2; in other embodiments, from 10 to 20%. In aspect, the total weight of the projectile 2 with a payload media can be about 5 to 10% of the weight of the equivalent projectile. In another aspect, the total "empty" weight of the projectile 2 without a payload media can be about 1 to 5% of the weight of an equivalent conventional projectile 2. In embodiments the total weight of the projectile is less than 5 grains. In embodiments the total weight of the projectile is less than 6 grains. In embodiments the total weight of the projectile is less than 7 grains. In embodiments the total weight of the projectile is less than 10 grains. Projectiles of less than 4.25 grains can be fired from telescoping 5.56 mm practice cartridges using only the propellant in the primer, at velocities up to about 520 fps using a metal driving band 16. With such velocities accuracy is extremely good and the kinetic energy is under 62 ft-lb/inch$^2$. This arrangement provides better accuracy and less energy than conventional 5.56 mm practice ammunition with marking projectiles. With less energy, the ammunition is safer.

The projectile body 6 can comprise principally a thermoplastic polymer. Other embodiments can comprise ceramic, compressed fibrous pulp, lightweight metal or other lightweight material that can be formed to define a projectile body 6. The driving band 14 can comprise a gilding metal, a rigid polymer different from the polymer used to form the projectile body or a metal impregnated polymer. According to an embodiment, the driving band can comprise 110 Copper (99.9% copper, 0.04% oxygen). The material of the driving band 14 provides more advantageous engagement characteristics than the base material of the projectile body 6. For example, better coefficient of friction with respect to firearm barrels, less sloughing of material, easier deformation to conform to the rifling of the barrel. The frangible cap 4 can comprise a frangible material adapted to fracture upon impact with the target to release the payload within the cavity and/or reduce force with which the projectile 2 impacts the target.

Figure 5:
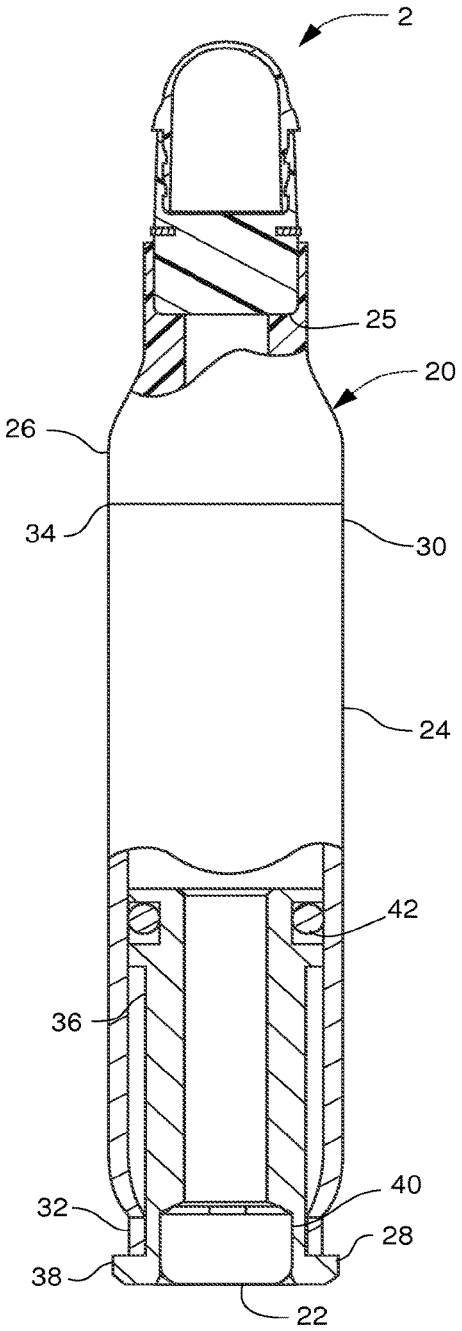
FIG. 5 is a partial cross-sectional side view of a non-lethal cartridge for firing a non-lethal projectile having a driving band according to an embodiment of the present invention.
Figure 6:
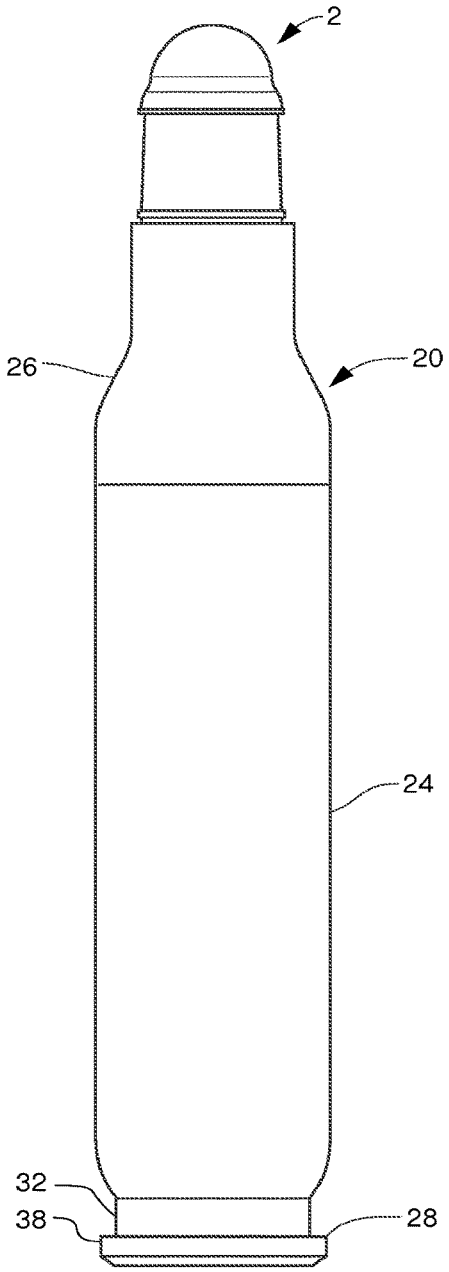
FIG. 6 is a side view of the non-lethal cartridge depicted in FIG. 5.

As shown in FIGS. 5 to 6, the non-lethal projectile 2 can be fired from a reduced energy cartridge 20 adapted to propel the projectile 2 with gases generated only by a primer 22. The cartridge 20 further comprises a cartridge casing 24, a neck portion 26 and a telescoping insert 28 adapted to telescope upon firing to trigger the cycling mechanism of the firearm. The cartridge casing 24 defines an internal cavity having a first opening 30 and a second opening 32. The neck portion 26 can comprise an insert portion 34 receivable within the first opening 30 affix the neck portion 26 to the cartridge casing 24.

The neck portion 26 can also comprise a seating portion 25 for receiving the projectile 2. According to an embodiment, the neck portion 26 can be shaped to fit within the chamber of a firearm sized for 5.56 NATO cartridges. According to an embodiment, the neck portion 26 can comprise a glass filed nylon that is resistant to the temperatures associated with the hot gases.

The telescoping insert 28 comprises a telescoping portion 36 and a rim 38. The telescoping portion 36 is receivable within the second opening 32 such that the rim 38 is positioned against the second opening 32. The telescoping insert 28 defines a channel 40 for receiving the primer 22 and adapted to channel gases generated by igniting the primer 22 toward the projectile 2. According to an embodiment, the telescoping portion 26 can further comprise a gasket 42 engagable to the casing 24 to prevent gases from escaping between the telescoping portion 26 and the casing 24.

During firing, the projectile 2 travels through the rifled barrel of the firearm and engages the rifling of the barrel. In one aspect, the driving band 16 is engraved by the rifling of the barrel. The rifling imparts a spin to the projectile 2 such that the projectile 2 is spin stabilized once the projectile 2 leaves the barrel. The driving band 16 comprises a material of sufficient hardness that permits the driving band 16 to be etched in the same way as a conventional bullet. After the initial etching, the projectile 2 travels through the barrel with minimal friction. Upon impact with the target, the frangible cap 4 fractures dispensing the marking media contained within the cup portion 10 at the impact site.

Similar projectiles directed containing marking fluid that are capable of receiving a low durometer-value core instead of marking fluid are disclosed in U.S. Pat. Nos. 7,225,741; 7,278,358;7,621,208;7,984,668;8,146,505; US Patent Publication No. 2011/0252999; US Patent Publication No. 2012/0017793; US Patent Publication No. 2012/0192755; and PCT Application No. PCT/US2012/067482. The above references are herein incorporated by references in their entirety.

Figure 7A:
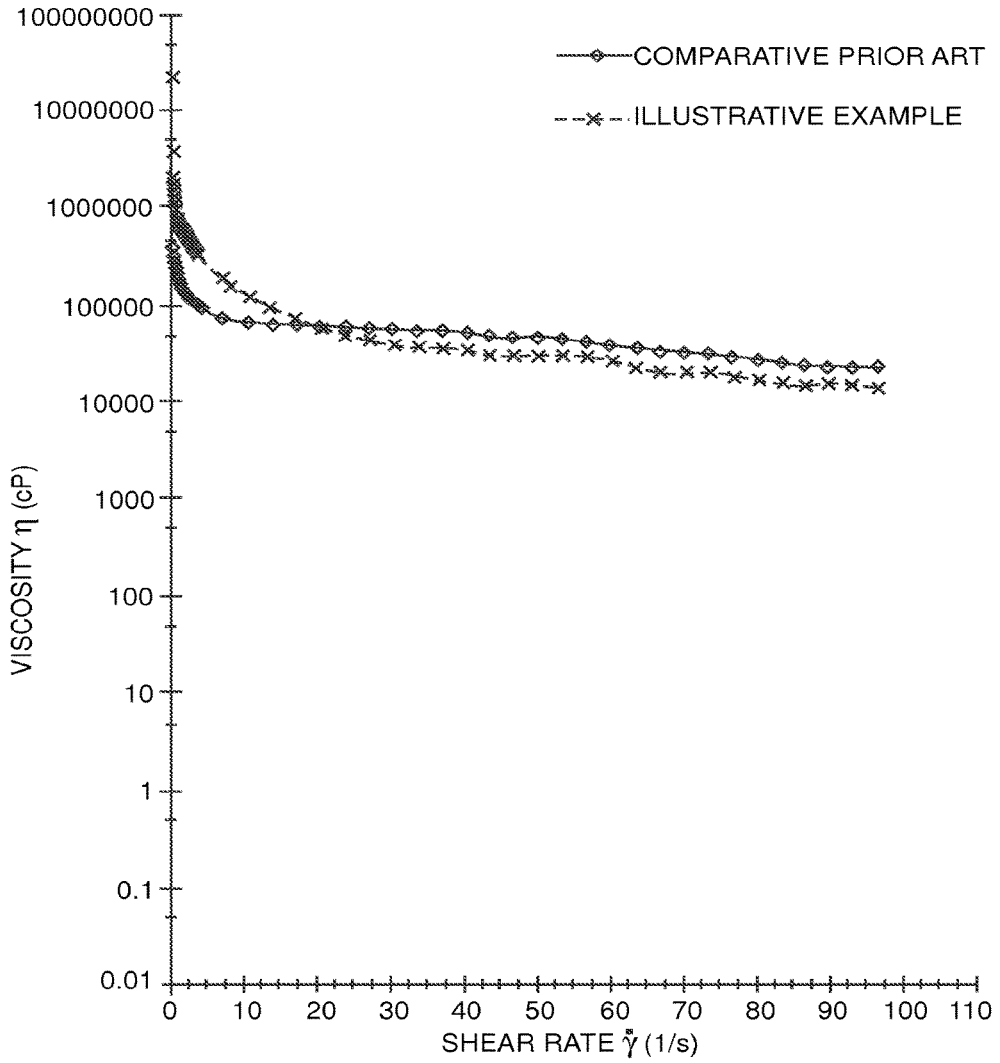
FIG. 7A is a graphical representation of the viscosity values of a shear-thinning exemplary embodiment of the present invention at various shear rates compared to the viscosity values of a comparative prior art marking projectile at similar shear rates.
Figure 7B:
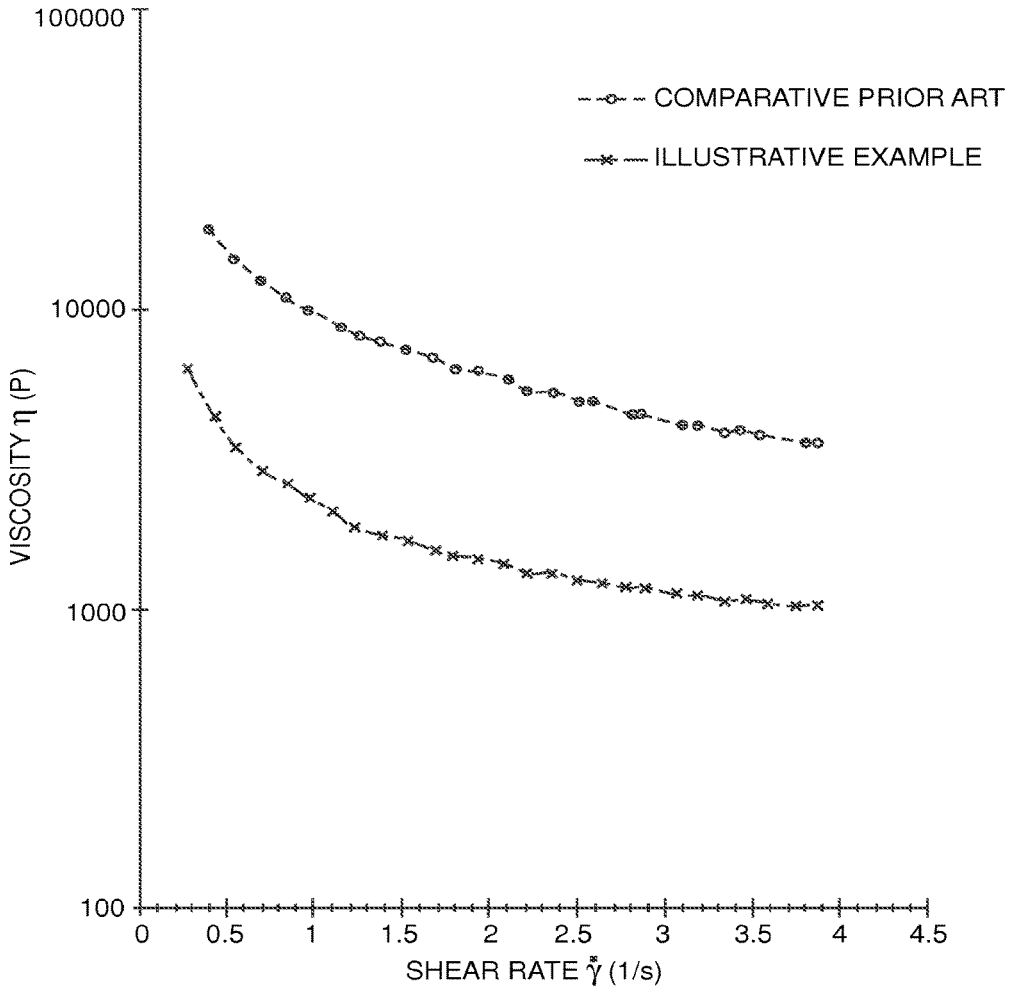
FIGS. 7B and 7C are close-up views of the graphical representation in FIG. 7A, with FIG. 7B being a close-up view at the low shear rate values less than about 4 and FIG. 7C being a close-up view at the high shear rate values greater than about 4.
Figure 7C:
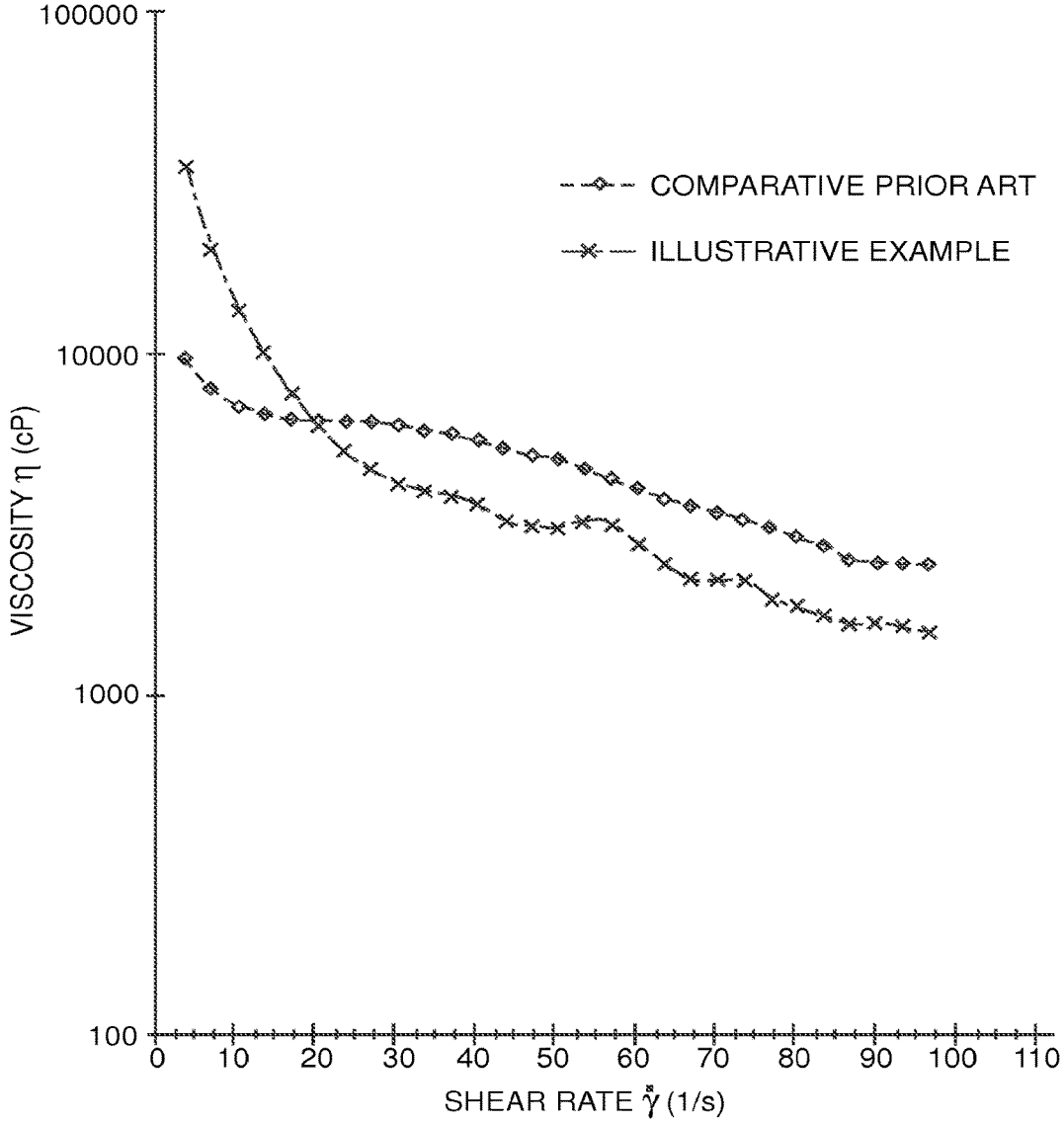

Referring now to FIGS. 7A-7C is graphically represented the viscosity values of a shear-thinning fluid of the present invention at the various shear rates provided in the Table below. In comparison, the viscosity values at about the same shear rates of a comparative commercial non-lethal marking round are provided in FIGS. 7A-7C. The comparative commercial non-lethal marking round being a blue Simunition® 9 mm marking training ammunition. As provided in comparison to the shear-thinning fluid of the present invention, the comparative commercial round has viscosity values greater than 30 Pa·sat shear rate values less than about 80 Hz, wherein the shear-thinning fluid in the non-lethal projectile of the present invention has viscosity values less than 30 Pa·sat shear rate values as low as about 50 Hz.

TABLE

| Time (s) t | Shear stress (Pa) τ | Shear Rate (1/s) Y | Viscosity (Pa · s) η | Temperature (° C.) T |
|---|---|---|---|---|
| 1 | 0.000 | 0.000 | 0.0000 | 25.0 |
| 2 | 143.021 | 0.006 | 22711.1702 | 25.0 |
| 3 | 587.340 | 0.145 | 4055.0869 | 25.0 |
| 4 | 725.582 | 0.390 | 1858.3751 | 25.0 |
| 5 | 790.082 | 0.532 | 1484.7538 | 25.0 |
| 6 | 853.398 | 0.683 | 1248.9942 | 25.0 |
| 7 | 906.873 | 0.828 | 1095.1146 | 25.0 |
| 8 | 956.425 | 0.954 | 1002.4833 | 25.0 |
| 9 | 1,000.917 | 1.137 | 880.5613 | 25.0 |
| 10 | 1,015.976 | 1.244 | 816.8738 | 25.0 |
| 11 | 1,070.026 | 1.367 | 783.0207 | 25.0 |
| 12 | 1,125.347 | 1.518 | 741.4950 | 25.0 |
| 13 | 1,166.013 | 1.672 | 697.3931 | 25.0 |
| 14 | 1,146.835 | 1.795 | 638.9912 | 25.0 |
| 15 | 1,203.855 | 1.924 | 625.7514 | 25.0 |
| 16 | 1,226.407 | 2.100 | 583.9524 | 25.0 |
| 17 | 1,192.623 | 2.207 | 540.3233 | 25.0 |
| 18 | 1,248.494 | 2.355 | 530.0948 | 25.0 |
| 19 | 1,237.090 | 2.503 | 494.2001 | 25.0 |
| 20 | 1,277.695 | 2.582 | 494.8595 | 25.0 |
| 21 | 1,258.578 | 2.805 | 448.6122 | 25.0 |
| 22 | 1,287.828 | 2.856 | 450.9404 | 25.0 |
| 23 | 1,276.423 | 3.089 | 413.2325 | 25.0 |
| 24 | 1,308.533 | 3.180 | 411.4643 | 25.0 |
| 25 | 1,303.094 | 3.338 | 390.4259 | 25.0 |
| 26 | 1,344.823 | 3.416 | 393.6445 | 25.0 |
| 27 | 1,340.765 | 3.533 | 379.5147 | 25.0 |

TABLE-continued

| Time (s) t | Shear stress (Pa) τ | Shear Rate (1/s) Y | Viscosity (Pa · s) η | Temperature (° C.) T |
|---|---|---|---|---|
| 28 | 1,366.776 | 3.804 | 359.3346 | 25.0 |
| 29 | 1,394.620 | 3.860 | 361.2718 | 25.0 |
| 30 | 1,384.890 | 3.930 | 352.4273 | 25.0 |
| 30 | 1,384.890 | 3.930 | 352.4273 | 25.0 |
| 31 | 1,380.172 | 4.002 | 344.8708 | 25.0 |
| 32 | 1,452.765 | 7.264 | 199.9937 | 25.0 |
| 33 | 1,421.682 | 10.702 | 132.8373 | 25.0 |
| 34 | 1,385.123 | 13.914 | 99.5481 | 25.0 |
| 35 | 1,317.921 | 17.302 | 76.1711 | 25.0 |
| 36 | 1,255.253 | 20.624 | 60.8638 | 25.0 |
| 37 | 1,222.459 | 23.914 | 51.1182 | 25.0 |
| 38 | 1,246.783 | 27.145 | 45.9306 | 25.0 |
| 39 | 1,259.385 | 30.495 | 41.2979 | 25.0 |
| 40 | 1,312.408 | 33.767 | 38.8670 | 25.0 |
| 41 | 1,393.886 | 37.092 | 37.5795 | 25.0 |
| 42 | 1,439.747 | 40.423 | 35.6170 | 25.0 |
| 43 | 1,398.152 | 43.761 | 31.9500 | 25.0 |
| 44 | 1,466.186 | 47.042 | 31.1679 | 25.0 |
| 45 | 1,516.251 | 50.326 | 30.1288 | 25.0 |
| 46 | 1,705.292 | 53.506 | 31.8711 | 25.0 |
| 47 | 1,768.876 | 56.998 | 31.0341 | 25.0 |
| 48 | 1,638.041 | 60.402 | 27.1192 | 25.0 |
| 49 | 1,504.419 | 63.654 | 23.6343 | 25.0 |
| 50 | 1,444.832 | 66.897 | 21.5978 | 25.0 |
| 51 | 1,495.484 | 70.225 | 21.2955 | 25.0 |
| 52 | 1,562.539 | 73.525 | 21.2517 | 25.0 |
| 53 | 1,443.451 | 76.857 | 18.7811 | 25.0 |
| 54 | 1,432.096 | 80.160 | 17.8656 | 25.0 |
| 55 | 1,401.281 | 83.497 | 16.7824 | 25.0 |
| 56 | 1,381.370 | 86.781 | 15.9178 | 25.0 |
| 57 | 1,465.122 | 90.037 | 16.2724 | 25.0 |
| 58 | 1,464.853 | 93.384 | 15.6863 | 25.0 |

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A marking projectile comprising:

a frangible shell of a polymeric material having an interior cavity; and a shear-thinning fluid within the interior cavity, the shear-thinning fluid comprising an emulsifying agent chosen from glyceryl stearate, PEG-100 stearate, petrolatum, glycol strearate, and mixtures thereof, and further comprising a colorant;

wherein the shear-thinning fluid has a spin-stabilizing viscosity that is greater than an impact dispersing viscosity, such that the impact dispersing viscosity of the shear-thinning fluid decreases with the rate of shear at impact with a target, and the impact dispersing viscosity of the shear-thinning fluid is less than about 30 Pa·s at a shear rate of about 20 Hz or greater at about 25° C., and the spin-stabilizing viscosity of the shear-thinning fluid is greater than about 130 Pa·s at shear rates less than about 2 Hz at about 25° C. in order to spin-stabilize the projectile.

2. The marking projectile of claim 1 wherein the frangible shell comprising a cylindrical portion, and wherein the frangible shell is configured to engage rifling in a barrel so that the projectile spins when fired through the barrel.

3. The marking projectile of claim 1, wherein the shear-thinning fluid comprises glycerin in an amount from about 50 wt % to about 70 wt %.

4. The marking projectile of claim 1, wherein the shear-thinning fluid comprises water in an amount from about 12 wt % to about 20 wt %.

5. The marking projectile of claim 1, wherein the shear-thinning fluid comprises an emulsifying agent in an amount from about 30 wt % to about 45 wt %.

6. The marking projectile of claim 1, wherein the shear-thinning fluid comprises an acrylate crosspolymer.

7. The marking projectile of claim 1, wherein the shear-thinning fluid comprises a C10-30 alkyl acrylate crosspolymer.

8. The marking projectile of claim 1, wherein the shear-thinning fluid comprises an acrylate crosspolymer in an amount from about 0.4 wt % to about 0.5 wt %.

9. The marking projectile of claim 1, in combination with a casing and propellant, the projectile disposed in the mouth of the casing.

10. The non-lethal marking projectile of claim 1 used in place of a cartridge having a bullet.

11. The non-lethal marking projectile of claim 1 used in place of a 5.56 mm cartridge having a bullet.

12. The non-lethal marking projectile of claim 1, used in place of a 9 mm cartridge having a bullet.

13. The non-lethal marking projectile of claim 1, wherein the shell comprises a cup connected to a frangible cup.

14. The non-lethal marking projectile of claim 1, wherein the cartridge is a reduced energy cartridge adapted to propel the projectile with gases generated only by a primer.

15. A non-lethal marking projectile comprising:

a frangible shell comprising a polymeric material having an interior cavity;

the frangible shell comprising a cylindrical portion, wherein the frangible shell is configured to engage rifling in a barrel so that the projectile spins when fired through the barrel; and a colored shear-thinning fluid within the interior cavity, the shear-thinning fluid comprising an emulsifying agent chosen from glyceryl stearate, PEG-100 stearate, petrolatum, glycol strearate, and mixtures thereof;

wherein the shear-thinning fluid has a spin-stabilizing viscosity that is greater than an impact dispersing viscosity, such that the impact dispersing viscosity of the shear-thinning fluid decreases with the rate of shear at impact with a target, and the impact dispersing viscosity of the shear-thinning fluid is less than about 25 Pa·s at a shear rate of about 20 Hz or greater at about 25° C., and the spin-stabilizing viscosity of the shear-thinning fluid is greater than about 340 Pa·s at shear rates less than about 3 Hz at about 25° C. in order to spin-stabilize the projectile.

16. The non-lethal marking projectile of claim 15, wherein the shear-thinning fluid comprises less than about 50 % by volume of a liquid portion.

17. The non-lethal marking projectile of claim 15, wherein the shear-thinning fluid has a pH between about 7 and about 8.

18. A non-lethal marking projectile comprising:

a frangible polymeric shell having an interior cavity;

the frangible shell comprising a cylindrical portion, wherein the frangible shell is configured to engage rifling in a barrel so that the projectile spins when fired through the barrel; and a shear-thinning fluid within the interior cavity; wherein the shear-thinning fluid has a spin-stabilizing viscosity that is greater than an impact dispersing viscosity, such that the impact dispersing viscosity of the shear-thinning fluid decreases with the rate of shear at impact with a target, and the impact dispersing viscosity of the shear-thinning fluid is less than about 30 Pa·s at shear rates greater than about 50 Hz at about 25° C., and the spin-stabilizing viscosity of the shear-thinning fluid is greater than about 900 Pa·s at a first shear rate less than about 2 Hz at about 25° C. in order to spin-stabilize the projectile.

19. The non-lethal marking projectile of claim 18 in combination with a casing and propellant.

* * * * *